US006874287B2

(12) United States Patent
Felser

(10) Patent No.: US 6,874,287 B2
(45) Date of Patent: Apr. 5, 2005

(54) STEEL STRUCTURE SYSTEM

(76) Inventor: Ludwig Felser, Kölner Strasse 34a, 51429 Bergisch Gladbach (DE)

( * ) Notice: Subject to any disclaimer, the term of this patent is extended or adjusted under 35 U.S.C. 154(b) by 0 days.

(21) Appl. No.: 10/311,159

(22) PCT Filed: Jun. 8, 2001

(86) PCT No.: PCT/DE01/02149

§ 371 (c)(1),
(2), (4) Date: Jun. 23, 2003

(87) PCT Pub. No.: WO01/96682

PCT Pub. Date: Dec. 20, 2001

(65) Prior Publication Data

US 2004/0010991 A1 Jan. 22, 2004

(51) Int. Cl.[7] ..... E04B 1/00

(52) U.S. Cl. ..... 52/251; 52/262; 52/264; 52/266; 52/403.1

(58) Field of Search ..... 52/251, 262, 264, 52/266, 403.1, 167.1–167.9, 250

(56) References Cited

U.S. PATENT DOCUMENTS

| | | | | |
|---|---|---|---|---|
| 3,058,264 A | * | 10/1962 | Varlonga | 52/236.9 |
| 3,110,982 A | * | 11/1963 | Besinger | 52/301 |
| 3,290,851 A | | 12/1966 | Sherburne | |
| 3,514,917 A | | 6/1970 | Merrill, Sr. | |
| 3,712,008 A | * | 1/1973 | Georgiev et al. | 52/79.12 |
| 3,783,565 A | * | 1/1974 | Hughes | 52/127.1 |
| 3,791,093 A | * | 2/1974 | Finsterwalder et al. | 52/745.04 |
| 4,054,014 A | * | 10/1977 | van der Lely | 52/745.03 |
| RE30,280 E | * | 5/1980 | Berman et al. | 52/122 |
| 4,646,495 A | * | 3/1987 | Chalik | 52/236.8 |
| 4,733,512 A | * | 3/1988 | Kiselewski | 52/238.1 |
| 5,671,569 A | * | 9/1997 | Kobori et al. | 52/167.6 |
| 6,460,297 B1 | * | 10/2002 | Bonds et al. | 52/79.1 |

FOREIGN PATENT DOCUMENTS

| | | |
|---|---|---|
| DE | 2 043 784 | 4/1971 |
| DE | 2149168 | 4/1973 |
| DE | 197 45 840 A1 | 4/1999 |

OTHER PUBLICATIONS

Buchenau/Thiele STAHLHOCHBAU, Teil 2, by Von Dipl, –Ing, Albrecht Thiele, 1985.

* cited by examiner

*Primary Examiner*—Jeanette E. Chapman
(74) *Attorney, Agent, or Firm*—Brooks Kushman P.C.

(57) ABSTRACT

The invention relates to a steel structural system for erecting stories of buildings, especially stories containing dwelling rooms, work rooms or rooms for accommodating household appliances where at least one floor structure (3) and ceiling structure (30) are provided, that each ceiling structure (30) serves as a floor structure (3) for another story, that load-bearing story supports (2) are arranged on the floor structure (3), and the ceiling structure (30) rests on these story supports, that an elastically sound-dampening joining system (4) is provided, which joins each of the story supports (2) with the floor structure (3), that the joining system (4) has a securing element (5), which is provided for laterally fixing the story support (2) to the floor structure (3), and is joined to the floor structure (3), that the joining system (4) exhibits a separating layer made out of flexible material with a high degree of resilience when deformed and a low plastic long-term compression, and that the separating layer is arranged between the securing element (5) joined to the floor structure (3) and the story support (2).

20 Claims, 4 Drawing Sheets

1
2
2a
16
15
13
2b
10a
10b
14
7
12
12
4
6
9
10
5
6
9
8
3
11

STEEL STRUCTURE SYSTEM

The invention relates to a steel structural system for erecting stories of buildings, especially stories containing dwelling rooms, work rooms or rooms for accommodating household appliances.

Steel structures are very rarely encountered in home construction. One important reason why is the exceedingly good ability of steel to transmit structure-borne noise, which is undesired in home construction.

Known in the art is a steel structure in which a balcony carrier is screwed to a building structure with a polyethylene plate interspersed. In addition to dissipating heat, the polyethylene plate has a slight insulating effect on the structure-borne noise. The disadvantage to this structure is that the balcony carrier and building structure have flanges with through holes for screwed joints. The screwed joints exhibit several screws pre-stressed with nuts, which penetrate through the flange and polyethylene plate. In this solution, structure-borne noise is transmitted unimpeded, at least via the screw shanks. Furthermore, with this solution, the resonance frequency of a massive plate made out of polyethylene is much too high to achieve an acceptable reduction in structure-borne noise transmission.

The object of the invention is therefore to provide a steel structural system that is easy to manipulate and connect, which almost completely prevents the transmission of structure-borne noise between individual stories, while at the same time still satisfying all requirements placed on the strength of the building structure in terms of structural statics.

This technical problem is resolved according to the invention by virtue of the fact that at least one floor structure and one ceiling structure is provided, that each ceiling structure serves as a floor structure for an additional story, that load-bearing story supports are arranged on the floor structure, and the ceiling structure rests on these story supports, that an elastically sound-dampening joining system is provided, which joins each of the story supports with the floor structure, that the joining system has a securing element, which is provided for laterally fixing the story support to the floor structure, and is joined to the floor structure, that the joining system exhibits a separating layer made out of flexible material with a high degree of resilience when deformed and a low plastic long-term compression, and that the separating layer is arranged between the securing element joined to the floor structure and the story support.

In particular the story supports as well as the floor and ceiling structure support beams are made out of steel. The perceived big advantage to the steel structural system according to the invention lies in the fact that the steel structural components of the individual building stories are separated from each other by the separating layer comprised of a flexible material, wherein no metal screw joints, in particular, are used. The transmission of structure-borne noise is eliminated or drastically reduced by virtue of the fact that the flexible material exhibits a high resilience when deformed, as well as a low plastic long-term compression. When installed, such a material exhibits a resonance frequency not exceeding 15 Hz under a permanent pressure exerted by the building story resting thereupon. Only this technical measure has made it possible not to transmit the structure-borne noise arising within a story structure into an overlying or underlying building story. The separating layer made out of flexible material here performs two functions. First, it decouples the bottom of the story support resting on the floor structure from the floor structure. To this end, the separating layer is arranged in a horizontal plane between these two building sections. Secondly, the securing element used for laterally fixing the story support is elastically decoupled from the story support in essentially a radial direction of the latter. To this end, at least sections of the flexible securing element are laterally provided with the separating layer, so that the story support only contacts the securing element indirectly via the separating layer.

One property of the flexible material comprising the separating layer is that its resonance frequency rises as does the permanent pressure under which the separating layer is compressed. The highest permanent pressures are reached on the section of the separating layer arranged in the horizontal plane, which separates the bottom of the story support from the floor structure. The entire building story or even several building stories here rest on the separating layer. Buildings with a low number of stories can be erected today with the currently available flexible materials. In higher buildings, the sustainable permanent load exerted on the flexible separating layer by the weight of the building and interior fittings can become too great.

The permanent pressure cannot exceed a specific limit, at which the flexible material still exhibits a resonance frequency of about 15 Hz, for example. At resonance frequencies exceeding the respective limit, the desired sound-insulating effect of the flexible separating layer is no longer achieved to the extent sought. Of course, applications in which the resonance frequency to be achieved can even be a bit higher are conceivable, because the resultant transmittable structure-borne noise can be tolerated. This can be the case in work rooms, for example, in which an elevated noise level prevails anyway. A better material might also become available in the future, which yields the desired low resonance frequency at even higher permanent pressures as the material existing today.

In addition to the reduced structure-borne noise transmission, the steel structural system according to the invention also provides for particularly good electrical insulation and seamless thermal insulation.

The steel structural system according to the invention comprises separating layer material of varying qualities. The separating materials are categorized into permanent load ranges for which they can be used. In multi-story buildings, the lowermost story must use material that can withstand the permanent pressure of all overlying stories and interior fittings, for example at a required resonance frequency of <15 Hz. The overlying story is decoupled with a separating layer material that reaches a resonance frequency of <15 Hz at a lower permanent pressure. The varying qualities of the separating material can be color or letter coded to prevent mistakes during assembly.

Provided in this way is a steel structural system based on a modular concept, with which building stories, in particular stories with dwelling rooms, work rooms or rooms for accommodating household appliances, can be erected especially quickly. In addition to the static requirements for the separating layer material, the story heights and spans between the story supports are best prescribed in increments. Separating layers varyingly dimensioned in terms of their geometry are available for different load classes. The proposed steel structural system not only facilitates the erection of building stories, but also streamlines permits with respect to structural statics, since evidence relating to structural statics can be categorized and transferred from one construction project to another.

In a structural steel system whose story supports have a self-contained, tubular section, the securing element of the joining system is favorably designed as a securing mandrel, and the securing mandrel placed on the floor structure projects into the clear of the story support resting on the floor structure. The story support is particularly simple to assemble, because no additional joining element, such as a screwed joint, is required. Another benefit stems from the fact that all sections of the joining system are incorporated inside or underneath the story support in a completely assembled state, and a smooth, tubular floor support is present for purposes of further expansion and erection of the wall structure over the entire height of the story.

To improve manipulation even further, it is helpful for the separating layer to be designed as a hat-shaped separating element, and exhibit a separating collar that resembles the brim of a hat, that the separating layer be placed on the securing mandrel, and the separating collar of the separating layer be arranged between the face of the floor support resting on the floor structure an the floor structure itself. Despite the functional separation of the separating layer into an area situated in a horizontal plane between the floor support and floor structure and an area that decouples the floor support in a radial direction from the securing element of the joining system, a hat-shaped, one-piece separating element is best used for ease of manipulation.

Also useful is a securing mandrel shaped like a truncated cone, and a floor support provided with a frontal centering receptacle, which interacts with the truncated cone of the securing mandrel via an interspersed separating layer. A coaxial layer between the floor support and securing mandrel is ensured in this way. This technical measure also simplifies the erection of the building, since the truncated cone acts as a guiding aid when setting the floor support onto the securing mandrel. The relatively heavy floor supports are normally positioned over the joining point by means of a hoist. The guiding aid simplifies assembly for the erecting engineer, who must guide the floor support onto the securing mandrel by hand. In addition, the guiding aid makes it possible to assemble the steel structural system more quickly. In terms of sound decoupling, the advantage to the truncated cone of the securing mandrel is that the circular projection surface of the cone, arising when viewed from above, absorbs some of the compressive load acting in the longitudinal direction of the story support. This tends to reduce the compressive load in the area of the separating layer arranged in a horizontal plane. This is accompanied by a reduction in the permanent pressure load and resonance frequency of the separating layer.

Another measure for abating noise inside a building story is achieved by filling the tubular section of the story support with concrete. In this way, the tubular story support assumes the property of a sounding board, which radiates sound when excited in whatever way, like the resonating body of a musical instrument. Further, a concrete-filled story support increases the fire safety of the building. This is because the danger of a dropping modulus of elasticity for the steel tubular steel of the story support during a rise in temperature is ameliorated. In the event of fire, the concrete absorbs a considerable amount of heat, which otherwise would cause the temperature of the story support to rise very rapidly, and diminish the stability.

One alternative embodiment of the steel structural system can exhibit a story support with a massive rod or an open section, wherein the securing element abuts the story support laterally from outside with the separating layer interspersed, and is joined with the floor structure. Possible sections include T-beams, double T-beams or U-beams. The interstices of such beams can also be provided with concrete.

Beams with open sections most often have flat surfaces arranged at right angles relative to each other, so that wall elements, windows and other structural elements can be more easily positioned than, for example, on story supports with a round cross section.

The flexible material of the separating layer preferably has a dynamic modulus of elasticity between 4 $N/mm^2$ and 8 $N/mm^2$. The flexible material of the separating layer advantageously consists of expanded polyurethane with a closed-cell structure. As has been shown, this material has the load-bearing capabilities required in terms of structural statics on the one hand, and its cell structure with gas-filled cells makes it useful for decoupling sound.

Another benefit is derived from expanded polyurethane having a cell framework that enables the high resilience of the separating layer after deformed. In another type of foamed material, the resilience stems from the inner pressure of the gas filled into the foam cells. Since the relatively thin-walled foam cells never tolerate a high inner pressure, the resilience of such foamed materials is very limited, and the latter exhibit distinctly higher compression sets after exposed to a compressive load. This is different for the proposed expanded polyurethane. As mentioned, expanded polyurethane derives its resilience from the cell structure itself, and therefore retains its resilience and low resonance frequency for a long time virtually unchanged, even under a permanent load.

In a modification of the steel structural system, an additional separating layer is arranged on the end of the floor support facing the ceiling structure, which brings about a sound decoupling relative to the ceiling structure. The additional separating layer hence sound decouples the story support at its end facing the floor structure by way of the joining system, as well as at the end facing the ceiling structure.

To simplify matters, the ceiling structure has secured to it a joining element facing the floor structure, with which the ceiling structure rests on the story support with the additional separating layer interspersed.

In order to laterally fix the story support on its end facing the ceiling structure as well, both the story support and the additional separating layer extend over the joining element secured to the ceiling structure.

Finally, a joining system for the sound-decoupled securing of a story support on a floor structure or ceiling structure is proposed, with a securing element attachable to the floor structure or ceiling structure for the lateral fixation of the story support, and a separating layer made out of flexible material, which exhibits a high resilience when deformed, and a low plastic long-term compression.

The invention shall be illustrated by example based on a drawing and described in detail based on the individual figures below: Shown on:

Figure 1:
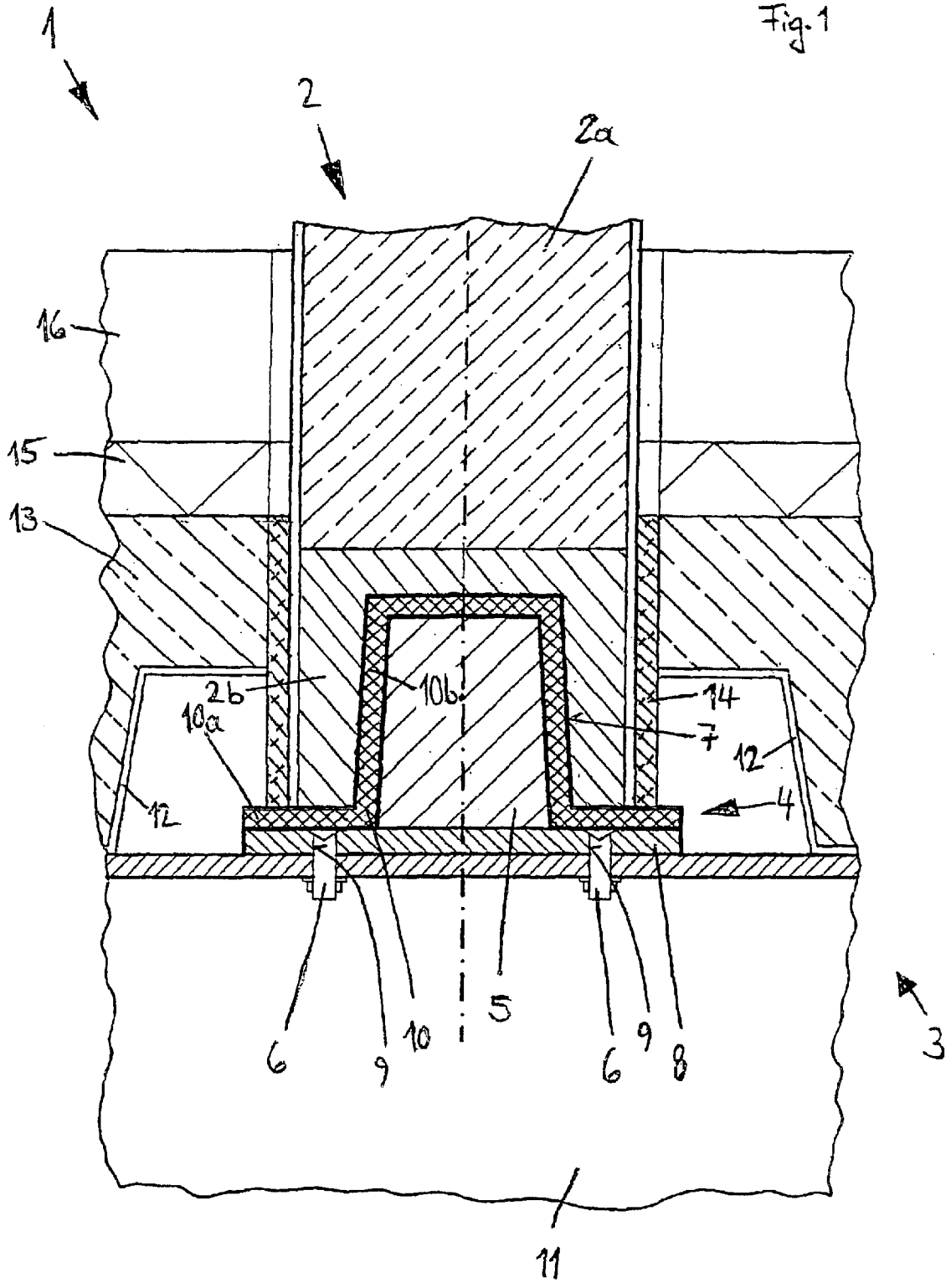
FIG. 1 is a sectional view through a floor structure and an abutting story support, cutout.

FIG. 1 of the drawing shows a joining point of a magnified view of a steel structural system 1. This case involves a story support 2, whose end facing a floor structure 3 is joined with the floor structure 3. A sound-decoupling joining system 4 is provided for joining purposes.

The joining system 4 has a securing element 5, which is provided on the floor structure 3 for laterally fixing the story support 2, and rigidly attached to the floor structure by screws 6. The joining system 4 has a securing mandrel 7 shaped like a truncated cone, which is provided with an attachment plate 8. The attachment plate 8 has holes 9 for accommodating the screws 6, with which the securing element 5 is fixed to the floor structure 3. The securing mandrel 7 and attachment plate 8 are enveloped by a separating layer made out of flexible material with a high resilience when deformed, which is designed as a hat-shaped separating element 10. The separating element 10 has a separating collar 10*a* that resembles the brim of a hat, which extends in the horizontal plane of the floor structure, and sound decouples the latter from the face of the erected story support 2.

The area 10*b* of the separating element 10 abutting the securing mandrel 7 shaped like a truncated cone contacts a pot-shaped centering receptacle 2*b*, which sits in the clear of the story support 2. It is approximated to the shape of the securing mandrel 7, and rigidly attached to the tubular wall of the story support 2. In this way, the story support 2 is both laterally fixed, and sound-decoupled in the radial direction from the securing mandrel 7 joined with the floor structure 3. The centering receptacle 2*b* also conforms to one side of the separating element 10, as the securing mandrel 7 does to the opposing side of the separating element 10. The centering receptacle 2*b* forms a floor inside the story support 2, up to which the concrete filling 2*a* reaches. The embodiment of a story support 2 provided with a centering receptacle 2*b* is advantageously prefabricated together with the concrete filling 2*a*. During assembly at the construction site, no fresh concrete need then be processed, thereby reducing the installation time.

Another alternative of a concrete-filled story support 2 (not shown) is built without a floor in the form of a centering receptacle 2*b*. Due to the missing floor, the concrete 2*a* is in direct contact with the separating element 10, as can be clearly gleaned from FIG. 1. To achieve a good contact, the story support 2 is first set up empty, without concrete filling. Only when the story support 2 has been set up over the securing mandrel 7 is a filling 2*a* consisting of fresh, non-shrinking, swellable, fine concrete. The fine concrete sets in the mold defined by the securing mandrel 7 and the separating element 10, and, after it has set, provides for centering and a good transfer of force between the floor structure 3 and the story support 2.

The floor structure 3 visible on FIG. 1 essentially consists of a load-bearing beam 11, to which the attachment plate 8 of the securing mandrel 7 is screwed, a sheet with trapezoidal corrugations 12 resting on the load-bearing beam 11, which is filled with concrete 13. In the area of the sheet with trapezoidal corrugations 12 and the concrete 13, the story support 2 is provided with a jacket 14, which prevents direct contact between the concrete 13 and tubular steel of the story support 2, among other things to provide protection against corrosion. A footfall sound dampener 15 and, over that, a flooring panel 16, rests on the concrete 13.

In the finished rooms of the building story, the joining system 4 is concealed inside the floor structure 3. Only the smooth surface of the story support 2 is visible. Non load-bearing wall structures can be secured to the latter.

Figure 2:
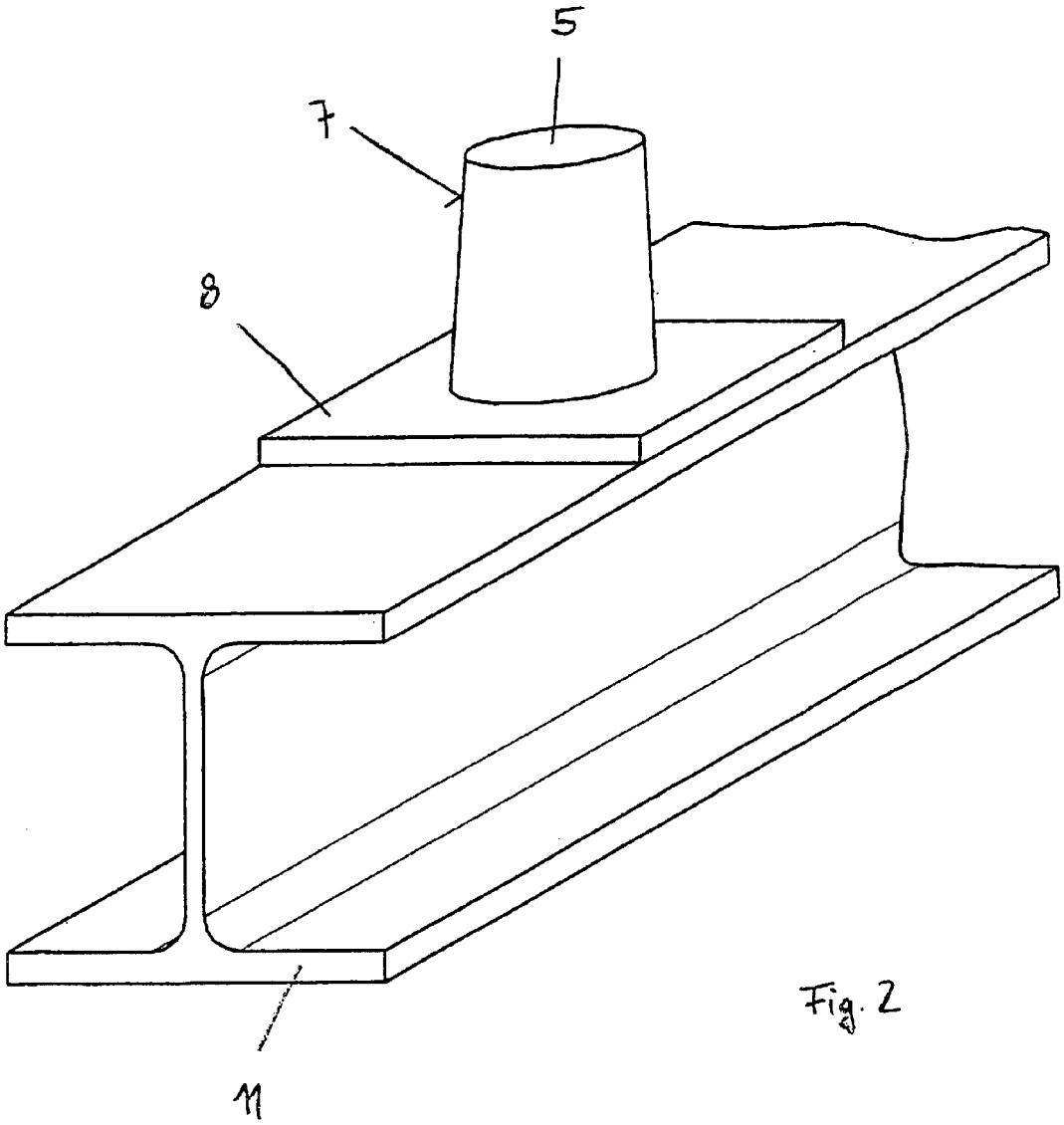
FIG. 2 is a perspective view of a steel beam carrying a securing mandrel resembling a truncated cone, on which a story support can be centrally erected.

FIG. 2 shows a perspective view of a load-bearing beam 11, to which a securing element 5 is attached for laterally fixing a story support. The load-bearing beam 11 is a double T-beam. The securing element 5 has a securing mandrel 7 shaped like a truncated cone, whose large cylindrical base accommodates an attachment plate 8. In turn, the latter is bolted to the load-bearing beam 11 by means of screwed joints (not shown).

Figure 3:
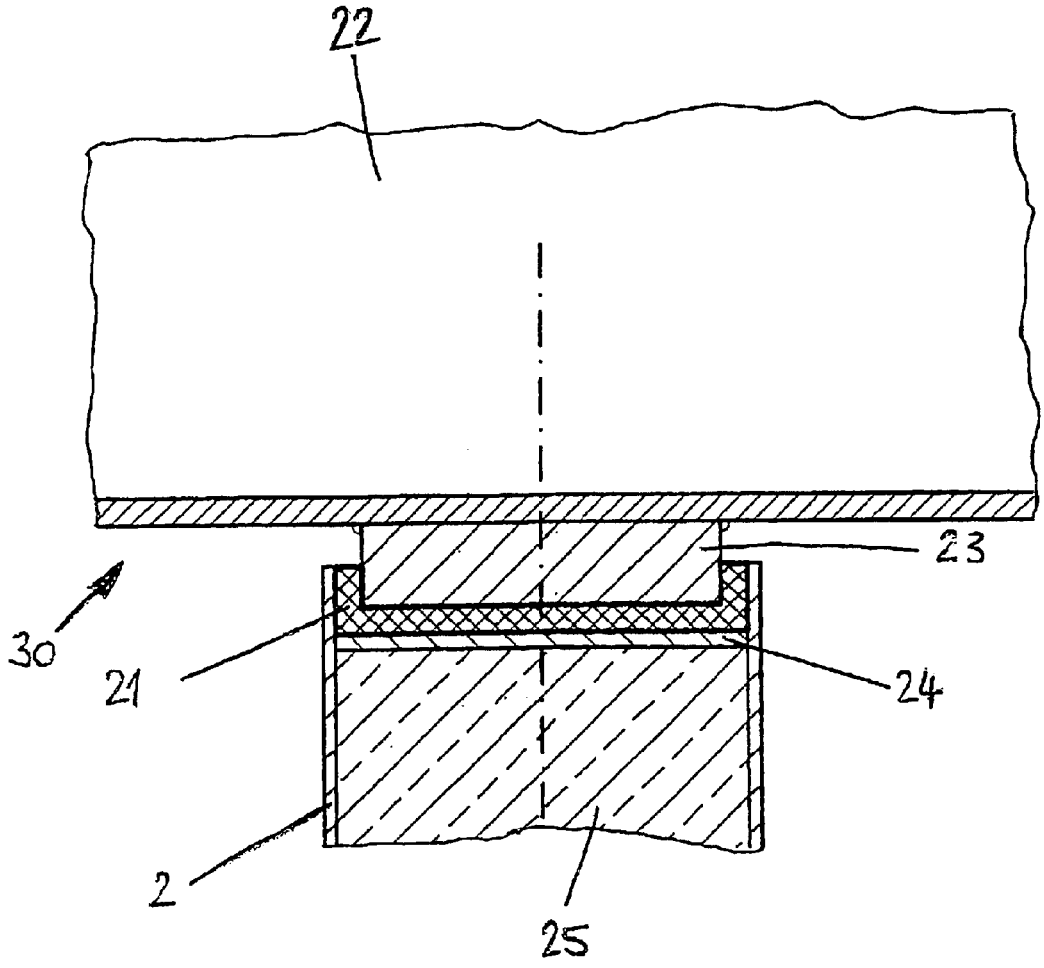
FIG. 3 is a sectional view through a ceiling structure resting on a story support, cutout.

FIG. 3 shows an alternative or optional measure used to solve the underlying technical problem. It involves an additional separating layer 21 arranged between a ceiling structure 30 and a story support 2. For the sake of simplicity, only one load-bearing beam 22 of the ceiling structure 30 is depicted. A joining element 23 for a story support 2 is welded to this beam in such a way as to project in the direction of the floor structure. A lagging floor 24 serving as a bed for the joining element 23 of the ceiling structure 30 is welded into the clear of the story support 2. The separating layer 21 is placed between the joining element 23 and the floor 24 of the story support 2. Both the story support 2 and the separating layer 21 extend over the joining element 23 of the ceiling structure 30 for laterally fixing the story support 2. This measure either permits an additional improvement of the sound decoupling for a story, or can be used as an alternative when the story supports on the floor structure cannot be sound decoupled for technical reasons. Sound decoupling of the story supports on the ceiling structure only is less effective than on the floor structure.

A concrete filling 25 of the story support 2 is visible underneath the floor 24.

A story support can be sound decoupled at both one of its two ends, or at both ends simultaneously. Sound decoupling in the area of the floor structure 3 is the most effective single measure. This is because structure-borne noise most arises from movements on the floor structure 3, and the structure-borne noise is in this way reduced near where it originates. One optional measure involving sound decoupling at the end of the story support 2 facing the ceiling structure 30 can be selected if a particularly good sound decoupling is desired.

Figure 4:
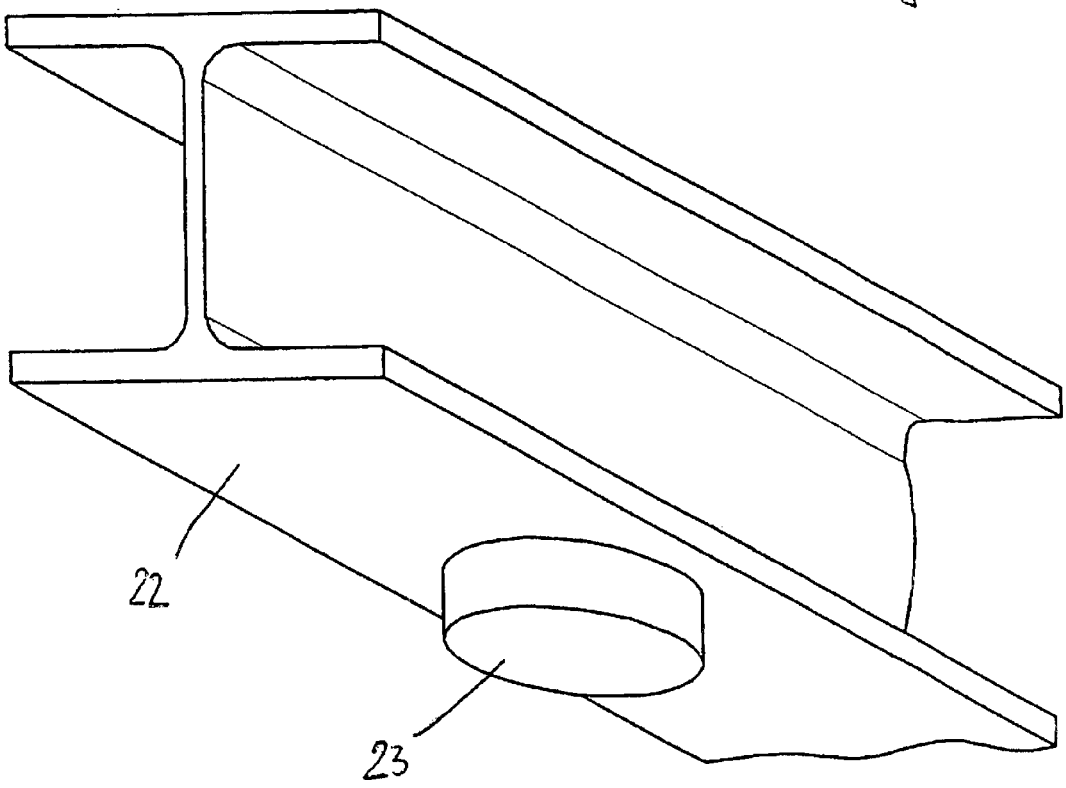
FIG. 4 is a perspective view of a steel beam with a joining element secured on the ceiling side, with which the ceiling structure rests on a story support.

FIG. 4 shows a perspective view of a load-bearing beam 22 of a ceiling structure 30 according to FIG. 3. The load-bearing beam 22 again involves a double t-beam, to which a cylindrical joining element 23 facing downward toward the floor structure is welded.

Reference List

1 Steel structural system
2 Story support
2*a* Concrete filling
2*b* Centering receptacle
3 Floor structure
4 Joining system
5 Securing element
6 Screw
7 Truncated cone-shaped securing mandrel
8 Attachment plate
9 Hole
10 Separating element
10*a* Separating collar
10*b* Area
11 Load-bearing beam
12 Sheet with trapezoidal corrugations
13 Concrete
14 Jacket
15 Footfall sound dampening
16 Flooring panel
21 Additional separating layer
22 Load-bearing beam
23 Joining element
24 Floor
25 Concrete filling
30 Ceiling structure

What is claimed is:

1. Steel structural system for erecting stories of buildings containing dwelling rooms, work rooms or rooms for accommodating household appliances, the structural system comprising:

at least one floor structure and at least one ceiling structure serving as a floor structure for another story;

a load-bearing story support support including a floor-facing end and a ceiling-facing end arranged on the at least one floor structure and supporting the at least one ceiling structure; and an elastically sound-dampening joining system, for joining the load-bearing story support with the at least one floor structure, wherein the elastically sound-dampening joining system includes a securing element for laterally fixing the story support to the at least one floor structure, and a separating layer comprising a flexible material with a high degree of resilience when deformed and a low plastic long-term compression;

wherein the separating layer is arranged between the securing element and the story support.

2. Steel structural system according to claim 1 wherein the story support support includes an tubular section wherein the securing element includes a securing mandrel located on the floor structure that projects into the clear of the story support.

3. Steel structural system according to claim 1, wherein the separating layer includes a separating collar resembling the brim of a hat, wherein the separating layer is placed adjacent the securing mandrel, and the separating collar is interspersed between the floor-facing end of the story support and the at least one floor structure.

4. Steel structural system according to claim 2, wherein the story support includes a centering receptacle interacting with a truncated cone shaped securing mandrel to establish a coaxial relationship between the story support and the securing mandrel, wherein the separating layer is interspersed between the story support and the centering receptacle.

5. Steel structural system according to claim 2, wherein the annular section is filled with concrete.

6. Steel structural system according to claim 5, wherein the concrete is fine, non-shrinking and non-swellable.

7. Steel structural system according to claim 1, wherein the story support includes an open section such that the securing element laterally abuts the story support and the separating layer is interspersed laterally between the securing element and the story support.

8. Steel structural system according to claim 1, wherein the separating layer has a dynamic modulus of elasticity between 4 $N/mm^2$ and 8 $N/mm^2$.

9. Steel structural system according to claim 1, wherein the separating layer comprises expanded polyurethane with a closed-cell structure.

10. Steel structural system according to claim 9, wherein the expanded polyurethane has a resilient cell structure.

11. Steel structural system according to claim 1, further comprising an additional separating layer adjacent the ceiling-facing end of the story support for sound decoupling between the ceiling-facing end of the story support and the ceiling structure.

12. Steel structural system according to claim 11, further comprising a joining element secured to the ceiling structure projecting towards the floor structure, wherein the additional separating layer is arranged between the joining element and the story support.

13. Steel structural system according to claim 12, wherein both the story support and the additional separating layer extend laterally over the joining element.

14. Joining system for the sound-decoupled securing of a story support on a floor structure comprising:

a securing element attachable to the floor structure adapted to laterally secure the story support; and a separating layer comprising a flexible material, which exhibits a high resilience when deformed, and a low plastic long-term compression.

15. Steel structural system for erecting stories of buildings containing dwelling rooms, work rooms or rooms for accommodating household appliances, the structural system comprising:

at least one floor structure and at least one ceiling structure serving as a floor structure for another story;

a load-bearing story support including a floor-facing end and a ceiling-facing end arranged on the at least one floor structure and supporting the at least one ceiling structure, wherein the story supports include a tubular section; and an elastically sound-dampening joining system for joining the load-bearing story support with the at least one floor structure, wherein the elastically sound-dampening joining system includes a securing element for laterally fixing the story support to the at least one floor structure, and a separating layer comprising a flexible material with a high degree of resilience when deformed and a low plastic long-term compression, wherein the separating layer is arranged between the securing element and the story support and the securing element includes a securing mandrel located on the floor structure that projects into the clear of the story support.

16. Steel structural system according to claim 15, wherein the separating layer is hat-shaped and includes a separating collar resembling the brim of a hat, wherein the separating layer is placed adjacent the securing mandrel and the separating collar is interspersed between the floor-facing end of the story support and the at least one floor structure.

17. Steel structural system according to claim 15 wherein the story support includes a centering receptacle interacting with a truncated cone shaped securing mandrel to establish a coaxial relationship between the story support and the securing mandrel, wherein the separating layer is interspersed between the story support and the centering receptacle.

18. Steel structural system according to claim 15, wherein the annular section is filed with concrete.

19. Steel structural system according to claim 18, wherein the concrete is fine, non-shrinking and non-swellable.

20. Steel structural system according to claim 15, wherein the story support includes an open section such that the securing element laterally abuts the story support and the separating layer is interspersed laterally between the securing element and the story support.

* * * * *